US010411370B2

(12) United States Patent
Albert et al.

(10) Patent No.: US 10,411,370 B2
(45) Date of Patent: Sep. 10, 2019

(54) HIGH-VOLTAGE CABLE SET

(71) Applicant: LEONI BORDNETZ-SYSTEME GMBH, Kitzingen (DE)

(72) Inventors: Volker Albert, Dettelbach (DE); Wolfgang Hauschild, Zirndorf (DE); Alexander Kett, Luhe-Wildenau (DE); Felix Ursprung, Schwarzach am Main (DE); Sascha Wolf, Bamberg (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 0 days.

(21) Appl. No.: 15/688,155

(22) Filed: Aug. 28, 2017

(65) Prior Publication Data

US 2017/0358874 A1 Dec. 14, 2017

Related U.S. Application Data

(63) Continuation of application No. PCT/EP2016/053953, filed on Feb. 25, 2016.

(30) Foreign Application Priority Data

Feb. 27, 2015 (DE) ..... 20 2015 100 962 U

(51) Int. Cl.

| | |
|---|---|
| ***H01R 9/03*** | (2006.01) |
| ***H01R 9/05*** | (2006.01) |
| ***H01R 13/6592*** | (2011.01) |
| ***H01R 13/6596*** | (2011.01) |
| *H01R 13/506* | (2006.01) |
| *H01R 4/72* | (2006.01) |

(52) U.S. Cl.

CPC ..... *H01R 9/032* (2013.01); *H01R 9/0518* (2013.01); *H01R 13/6592* (2013.01); *H01R 13/6596* (2013.01); *H01R 4/72* (2013.01); *H01R 13/506* (2013.01); *H01R 2201/26* (2013.01)

(58) Field of Classification Search

CPC .... H01R 9/0524; H01R 4/646; H01R 13/648; H01R 13/5208

USPC ..... 439/98, 587

See application file for complete search history.

(56) References Cited

U.S. PATENT DOCUMENTS 4,619,487 A * 10/1986 Brush, Jr. ..... H01R 13/6593 439/98
5,618,190 A 4/1997 Masuda et al.
5,691,506 A * 11/1997 Miyazaki ..... H01R 4/646 174/652
5,725,387 A * 3/1998 O'Sullivan ..... H01R 4/187 439/98

(Continued)

FOREIGN PATENT DOCUMENTS

CN 103262371 A 8/2013
EP 1164664 A2 12/2001

(Continued)

*Primary Examiner* — Hien D Vu

(74) *Attorney, Agent, or Firm* — Laurence A. Greenberg; Werner H. Stemer; Ralph E. Locher

(57) ABSTRACT

A high-voltage cable set, in particular for a vehicle electrical system, contains a plurality of cables, which are surrounded by a common shield, and a connector, which consists of a conducting material and is electrically connected to the shield. For this purpose, a contact sleeve is integrated into the connector, the shield being fastened to the contact sleeve. The risk of contact corrosion is thereby significantly reduced.

13 Claims, 3 Drawing Sheets

(56) References Cited

U.S. PATENT DOCUMENTS

| | | | | |
|---|---|---|---|---|
| 6,419,521 | B2 | 7/2002 | Kanagawa et al. | |
| 6,815,610 | B2 * | 11/2004 | Kuboshima | H01R 9/032 174/360 |
| 7,390,221 | B2 * | 6/2008 | Akino | H01R 9/0518 439/108 |
| 7,695,320 | B2 | 4/2010 | Tsukashima et al. | |
| 8,167,653 | B2 | 5/2012 | Hasegawa et al. | |
| 9,039,463 | B2 * | 5/2015 | Yamashita | H01R 13/6315 439/449 |
| 9,376,069 | B2 | 6/2016 | Nakai et al. | |
| 9,386,733 | B2 | 7/2016 | Adachi et al. | |
| 2003/0221850 | A1 | 12/2003 | Mizutani | |
| 2008/0207054 | A1 * | 8/2008 | Kim | H01R 13/7197 439/607.01 |
| 2013/0256467 | A1 | 10/2013 | Aumiller | |
| 2015/0126055 | A1 | 5/2015 | Morita | |

FOREIGN PATENT DOCUMENTS

| | | | |
|---|---|---|---|
| JP | H0945420 | A | 2/1997 |
| JP | 2002075557 | A | 3/2002 |
| JP | 2006344398 | A | 12/2006 |
| JP | 2010140757 | A | 6/2010 |
| JP | 2013074650 | A | 4/2013 |
| JP | 2014022046 | A | 2/2014 |
| JP | 2014060844 | A | 4/2014 |
| KR | 2020130003686 | U | 6/2013 |
| WO | 2008108300 | A1 | 9/2008 |

* cited by examiner

HIGH-VOLTAGE CABLE SET

CROSS-REFERENCE TO RELATED APPLICATION

This application is a continuation, under 35 U.S.C. § 120, of copending international application No. PCT/EP2016/053953, filed Feb. 25, 2016, which designated the United States; this application also claims the priority, under 35 U.S.C. § 119, of German patent application No. DE 20 2015 100 962.3, filed Feb. 27, 2015; the prior applications are herewith incorporated by reference in their entirety.

BACKGROUND OF THE INVENTION

Field of the Invention

The invention relates to an HV cable set.

An HV cable set, that is to say a high-voltage cable set, is used for example in a vehicle on-board electrical system, in particular in an electric vehicle, for the purposes of connecting an HV component, that is to say a high-voltage component. A common use is the connection of an electrical drive unit of an electric vehicle to a high-voltage supply in the vehicle on-board electrical system. Here, high-voltage is to be understood to mean in particular a voltage in the range from approximately 60 V to 1,000 V. The HV cable set typically contains, on an end side, a connector or connection by which a connection to the respective HV component is realized.

For the transmission of the electrical power, the HV cable set contains one or more cables. To protect the components of the vehicle against electromagnetic disturbances from the surroundings and against system-inherent disturbance voltages, the cables are commonly surrounded by a common shield, in particular a collective shield. This in turn is commonly connected, at an end side of the HV cable set, to an electrical ground potential, for example indirectly via a connector which is connected to the ground potential, for example a high-voltage plug connector into which the individual cables run. The shield is then for example crimped to a connection piece of the connector or is fixed to the connection piece by a cable tie.

For optimum shielding throughout, the shield must be permanently electrically contacted and fastened. In particular owing to the mechanical loads and alternating weather influences in the automotive sector, as durable a connection as possible is required. A problem here is in particular a high contact resistance, also referred to as contact transition resistance, owing to an inadequate pressing force, also referred to as contact force. A high contact resistance has a disadvantageous effect, in particular if the connection piece is manufactured from aluminum, if a corresponding oxide layer is formed on the surface thereof. Furthermore, at the transition between the shield and the connection piece, which are commonly manufactured from different materials, there is the risk of contact corrosion and an associated impairment of the connection.

SUMMARY OF THE INVENTION

Against this background, it is an object of the invention to specify an HV cable set, having a collective shield, the electrical connection of which in particular to a high-voltage component is improved. Here, it is the intention in particular for the risk of contact corrosion to be reduced or eliminated entirely.

The object is achieved according to the invention by means of an HV cable set having the features as per the main claim. The sub claims relate to advantageous embodiments, refinements and variants.

The HV cable set is provided and configured in particular for use in a vehicle on-board electrical system, and contains a number of cables which are surrounded by a common shield, in particular a ground shield. Furthermore, the HV cable set contains a connection piece composed of a conductive material, which connection piece is electrically connected to the shield by virtue of the fact that a contact sleeve is integrated into the connection piece, to which contact sleeve the shield is fastened.

A major advantage achieved with the invention consists in particular in that the shield and the connection piece are connected only indirectly via the contact sleeve, and thus direct contact between shield and connection piece is prevented. The shield and the connection piece are in this case spatially separated from one another, in particular are spaced apart in a longitudinal direction, but a complete, that is to say gapless, shield however remains insured by the contact sleeve. In particular, in the case of shield and connection piece being manufactured from different materials, contact corrosion between the two components is advantageously prevented. A further advantage therefore consists in particular in that the materials for the manufacture of the connection piece and of the shield can be selected without regard to their electrochemical interaction. This yields particularly great freedom in the selection of the materials and thus also in the design of the HV cable set.

Contact corrosion between the contact sleeve and the connection piece is then advantageously prevented by virtue of the contact sleeve being integrated into the connection piece. In this way, an ingress of moisture into a touching region in which the contact sleeve and the connection piece touch is efficiently prevented. In other words: an ingress of an electrolyte for forming a local element between the contact sleeve and the connection piece is prevented. This yields advantageously increased freedom for the selection of the materials of contact sleeve and connection piece.

The cables of the HV cable set are in particular high-voltage cables for transmitting electrical power. In particular, the HV cable set is configured such that the high voltage is transmitted in multi-phase form, wherein in each case one phase is transmitted by one cable. For example, the HV cable set is then of three-phase design and correspondingly contains three cables. These comprise in each case one conductor, which is surrounded by a suitable insulator. In view of the common shield, a separate shield, that is to say in particular individual shielding of the cables, is in particular omitted.

The connection piece in combination with the contact sleeve serves for the connection of the shield, and in particular for the connection thereof to an electrical ground potential. The connection piece is then for example a part of a connector, in particular plug connector, of a connection part or of a lead through, which is correspondingly connected to the ground potential. Here, the connection piece with the contact sleeve constitutes in particular an end-side delimitation of the shield. The shield then surrounds the cables as far as the contact sleeve, into which the cables correspondingly run. Then, in particular, contacting of the cable ends with corresponding connections is realized behind the connection piece. The connection point thus formed is then for example surrounded by a housing part which contains the connection piece. For the run-in of the cables, the connection piece contains in particular a lead-through through which the cables run. The connection piece thus encircles the cables. Similarly to the connection piece, it is in particular also the case that the contact sleeve encircles the cables, that is to say the cables run through a lead through of the contact sleeve. Here, it is possible for the contact sleeve to have a longitudinal slot in order, in particular, to avoid material stresses.

The shield is manufactured from electrically conductive material and is formed for example as a braid in order to realize particularly gapless and flexible shielding of the cables. In particular, the shield is in this case formed in the manner of a hose which surrounds the cables. At the end side, the shield is then attached to the contact sleeve, in particular is pushed onto a contact surface. In a radial direction, that is to say perpendicular to the longitudinal direction, the shield is then arranged around the contact sleeve. In other words: in the radial direction, the shield overlaps the contact sleeve at the end side.

The contact sleeve is preferably manufactured from a material whose electrochemical standard potential differs as little as possible, in particular by no more than 0.05 V, from that of the material of the shield. Since the shield is in particular connected directly to the contact sleeve, contact corrosion is reduced to a particularly great extent by at least similar standard potentials of the materials used. In a suitable refinement, the two materials are the same and correspondingly have the same standard potential, whereby contact corrosion is prevented in a particularly efficient manner. The contact sleeve thus acts in particular as an intermediary between the shield and the connection piece, which are not directly connected to one another.

Altogether, contact corrosion in the region of the contact sleeve is then avoided in a particularly optimal manner by virtue of the fact that the contact sleeve and the shield are manufactured from electrochemically at least similar materials, and the contact sleeve is integrated into the connection piece in a particularly sealed manner with regard to the ingress of an electrolyte.

The connection piece is preferably manufactured from aluminum and is thus particularly inexpensive to manufacture. Furthermore, the connection piece then in particular has an outer oxide layer which additionally protects the connection piece.

The shield is preferably manufactured as a braid composed of a multiplicity of zinc-plated copper wires, and is thus particularly flexible, that is to say in particular that the shield exhibits a high degree of freedom of movement. Furthermore, copper is suitable as material for the shield owing in particular to its high electrical conductivity. The multiplicity of wires permits particularly good contacting with respect to the contact sleeve, in particular owing to the thus enlarged surface area. In this way, it is in particular also the case that the contact resistance between contact sleeve and shield is particularly low.

The contact sleeve is preferably manufactured from brass. In particular in combination with a shield manufactured from copper, this yields a particularly small difference in electrochemical standard potentials of the two materials. In this way, the risk of contact corrosion is reduced to a particularly great extent.

The connection piece is expediently formed as a cast part, and the contact sleeve is partially encapsulated by casting in the connection piece. In this way, contact corrosion is prevented in a particularly efficient manner. During the encapsulation of the contact sleeve by casting, a touching region is formed in which the connection piece and the contact sleeve touch. As a result of the casting-around process, the connection piece and the contact sleeve are connected to one another in a particularly well-sealed manner in the touching region, that is to say an ingress of an electrolyte is prevented in an optimum manner. Furthermore, in the touching region, the formation of an oxide layer, in particular on the connection piece, is also prevented, such that it is additionally the case that there is a particularly low contact resistance between the contact sleeve and the connection piece.

In a preferred embodiment, the shield is cohesively connected to the contact sleeve, in particular by soldering or welding. In this way, a particularly firm connection with, in particular, a simultaneously particularly low contact resistance is produced between shield and contact sleeve. In particular in the case of a shield formed as a braid, a particularly large connection area is formed, as a result of which the connection is particularly firm.

In an embodiment which is particularly easy to manufacture, the contact sleeve is seated in a longitudinal direction in the connection piece. Here, the longitudinal direction corresponds in particular to the longitudinal direction of the HV cable set. As a result of the insertion in the longitudinal direction, it is furthermore the case that optimum purchase of the contact sleeve on the connection piece is realized. Here, the contact sleeve has a length in the longitudinal direction, and is preferably seated over at least one quarter of the length, and at most over one half of the length, in the connection piece. In this way, in particular, suitable mechanical stability is simultaneously achieved, and an adequately large contact area for the attachment of the shield to the contact sleeve is provided.

In particular, because the shield and the connection piece are spatially separated from one another, the contact sleeve has an encircling free region, which in particular points outward in a radial direction. In a preferred refinement, the free region is encapsulated by casting in a sealing material. In this way, the sealing action of the arrangement as a whole is advantageously improved, and contact corrosion between the connection piece and the contact sleeve in the vicinity of the free region is prevented. By the sealing material, it is then specifically the case that a possible ingress of an electrolyte via the free region is prevented. Here, the sealing material forms in particular a shell in which the connection piece is at least partially enclosed and the contact sleeve is in particular entirely enclosed. In the free region that is encased in this way, oxide formation and corrosion are then prevented in an efficient manner.

Here, "encapsulated by casting" is also to be understood in particular to mean encapsulated by foaming or encapsulated by injection molding. The sealing material is accordingly applied for example as a hardening foam compound around the contact sleeve. In particular, in this case, the sealing material forms a housing shell. In order in particular to improve the stability of the connection of sealing material, that is to say housing shell and contact sleeve, the latter has a number of recesses through which the sealing material extends. In this way, the sealing material engages into the contact sleeve and through the recesses into an interior space of the contact sleeve. In this way, particularly high stability is achieved in particular in the longitudinal direction, and furthermore, the interior space is also advantageously filled with sealing material, such that here, too, the risk of contact corrosion is advantageously reduced. Altogether, the sealing material thus serves in particular for covering exposed surfaces of the overall arrangement and for filling cavities.

The housing shell formed by the sealing material preferably has, on the outside, an encircling groove for receiving a cable tie. By the cable tie, it is possible in particular to realize a further fixing of the housing shell and to realize an additional clamping action, in particular in a radial direction. The encircling groove is preferably of fully encircling form and is expediently formed in a radial direction into the housing shell. In this way, in particular, an inadvertent displacement of the cable tie in the longitudinal direction is prevented. The encircling groove is suitably arranged around the contact sleeve such that the clamping force advantageously also acts directly on the contact region.

In the interior space of the contact sleeve, there is suitably arranged a tension relief means, by which it is ensured in a particularly simple manner that the cable is secured against being pulled out in the longitudinal direction.

In an expedient refinement, the HV cable set is connected by a connection part to an electrical HV component of a vehicle, in particular of an electric vehicle. The connection part serves in this case in particular for the connection of the HV cable set to a housing of the HV component. Correspondingly, the connection part then forms a lead-through for the cables of the HV cable set into or to the HV component. For this purpose, the connection part is preferably connected to the housing of the HV component in sealed, and in particular also electrically conductive fashion. The HV component is for example a high-voltage accumulator or a battery of the vehicle, an electric drive machine, a high-voltage distributor or a high-voltage plug connector. The housing of the HV component is then, with the connection part and the shield, connected to a common potential, in particular a ground potential.

Other features which are considered as characteristic for the invention are set forth in the appended claims.

Although the invention is illustrated and described herein as embodied in a high-voltage cable set, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
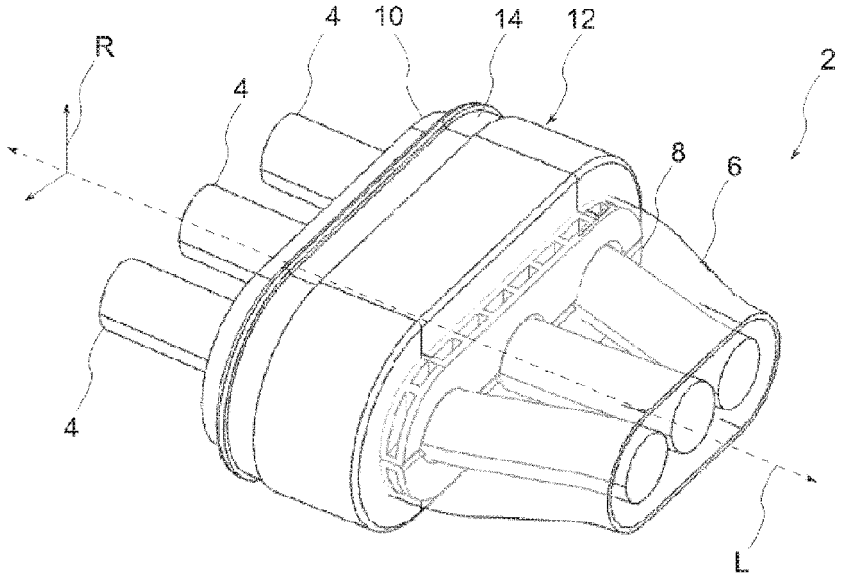
FIG. 1 is a diagrammatic, perspective view of a detail of an HV cable set.

Referring now to the figures of the drawings in detail and first, particularly to FIG. 1 thereof, there is shown a detail of an HV cable set 2 in an oblique view. The HV cable set 2 has a number of cables 4, which in this case are three phases of a high-voltage connection. The cables 4 are formed in each case without separate shielding, which is to say without individual shielding, and the cables 4 are rather surrounded by a common shield 6. The latter is in this case formed as a braid composed of tin-plated copper wires. The cables 4 are in this case secured in a tension relief device 8, and run through a connection piece 10 which is for example a part of a connector housing (not illustrated in any more detail here). Furthermore, a sealing material 12 is provided, which in this case additionally forms a housing shell which encircles the tension relief device 8, the cables 4, the shield 6 and the connection piece 10. An encircling groove 14, which is of fully encircling form, is formed into said housing shell in a radial direction R, which encircling groove serves for receiving a cable connector (not illustrated in any more detail here).

Figure 2:
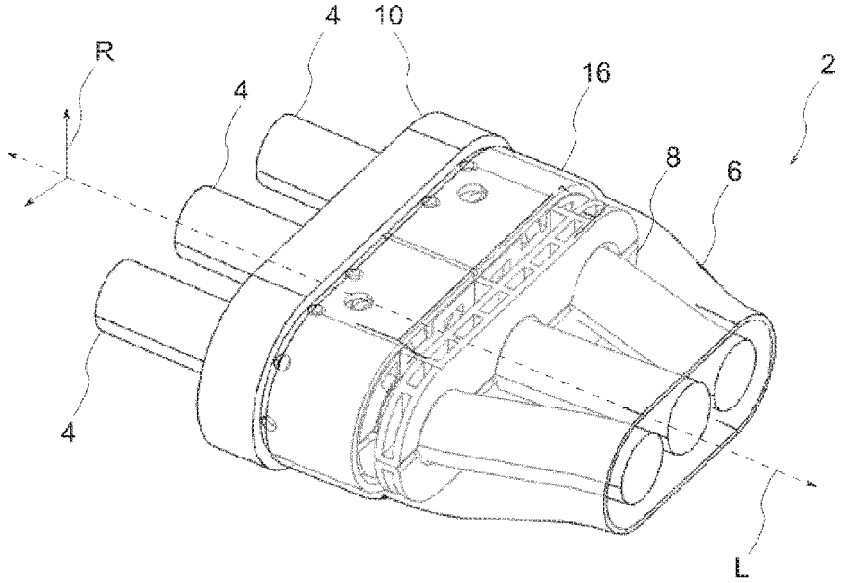
FIG. 2 is a perspective view of the arrangement as per FIG. 1 without a housing shell.

FIG. 2 illustrates the arrangement from FIG. 1 without the sealing material 12. It is possible here to clearly see a contact sleeve 16 which is enclosed by the sealing material 12 and which is integrated in a longitudinal direction L into the connection piece 10. In the embodiment shown here, the connection piece 10 is also formed in the manner of a sleeve and has, in the longitudinal direction L, a front surface into which the contact sleeve 16 is inserted in the longitudinal direction L. Here, the arrangement composed of contact sleeve 16 and connection piece 10 is produced in particular by virtue of the contact sleeve 16 being encapsulated by casting, at the end side, in material for forming the connection piece 10. In the embodiment shown here, the contact sleeve 16 furthermore has a longitudinal slot 17. In an alternative which is not shown, the contact sleeve 16 is produced for example by deformation of a tubular section, and then has no longitudinal slot 17.

Figure 3:
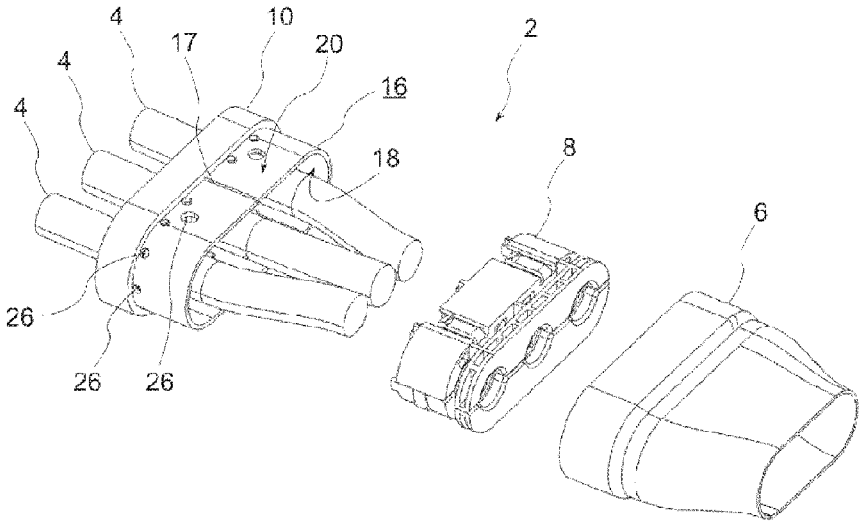
FIG. 3 is an exploded, perspective view of the arrangement as per FIG. 2.
Figure 4:
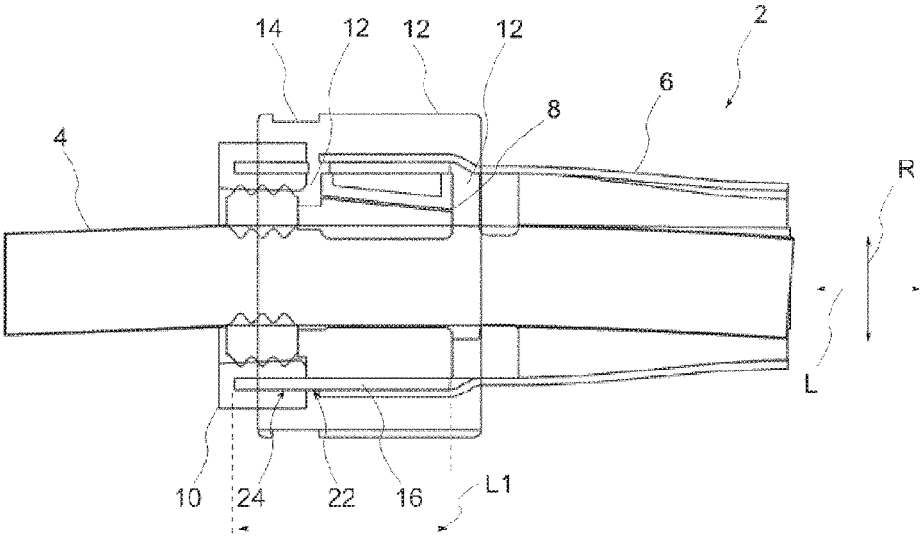
FIG. 4 is a sectional view of the arrangement as per FIG. 1.

The construction is illustrated further by the exploded illustration in FIG. 3 and by the sectional illustration in FIG. 4. It can be seen that the contact sleeve 16 has an interior space 18 in which the tension relief device 8 is seated. The shield 6 is then pushed in the longitudinal direction L onto the contact sleeve 16, specifically in such a way that said contact sleeve is seated at the end side in the shield 6 and is surrounded by the latter. The contact sleeve 16 thus has a contact surface 20 which points outward in the radial direction R and which serves for producing an electrical connection to the shield 6. In particular, the shield is soldered or welded to the contact surface 20.

As is clear in particular from FIG. 4, there is formed on the contact sleeve 16 a free region 22 which is covered neither by the shield 6 nor by the connection piece 10 in the radial direction R. The free region 22 is however optimally covered by the sealing material of the housing shell 12, such that an ingress of moisture is prevented. In this way, contact corrosion between connection piece 10 and contact sleeve 16 at the edge of the free region 22 is also prevented.

It can also be clearly seen that the contact sleeve 16 has a length L1 in the longitudinal direction L, and is seated over approximately one third of the length L1 in the connection piece 10. In this way, between connection piece 10 and contact sleeve 16, there is formed a touching region 24 in which, in this case, owing to the production process, no air inclusions are present and an oxidation of the material of the connection piece 10 is avoided. In this way, in the touching region 24, particularly low contact resistance is realized, and contact corrosion, that is to say the formation of a local element, is efficiently prevented.

As shown for example in FIG. 3, a number of recesses 26 is formed into the contact sleeve 16 in the radial direction R, through which recesses the sealing material 12 ingress into the interior space 18 of the contact sleeve 16. This also clearly emerges from FIG. 4. In this way, it is in particular the case already during the production process that any error and moisture are displaced out of the interior of the arrangement, and thus the risk of contact corrosion as a result of an ingress of an electrolyte is eliminated.

Figure 5:
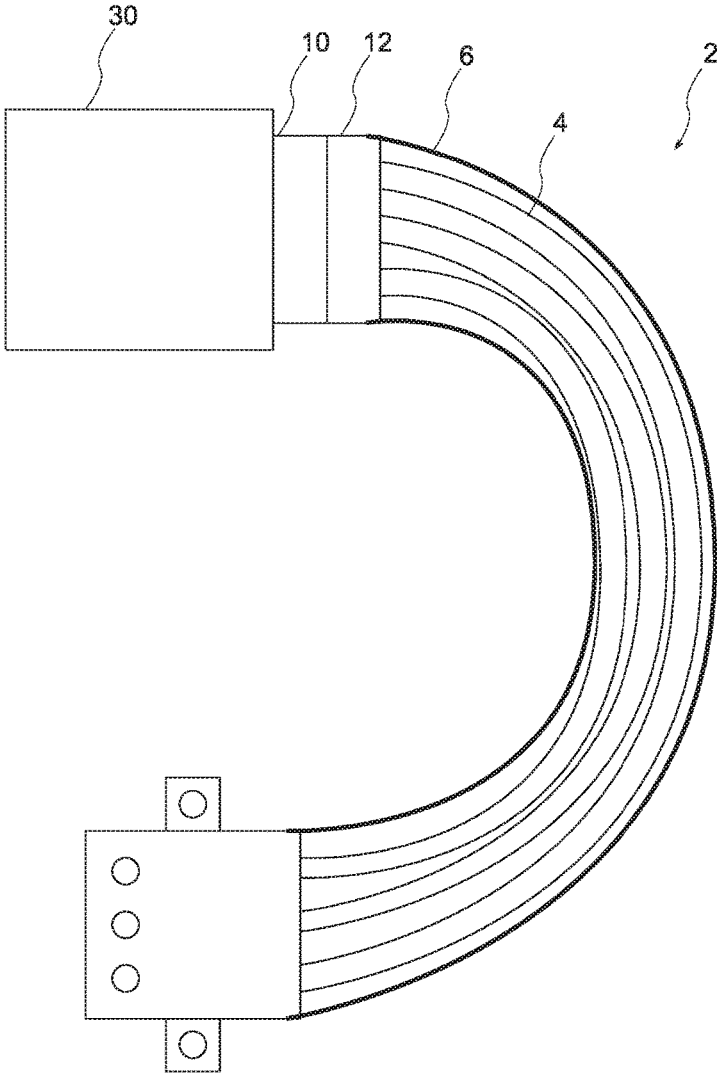
FIG. 5 is an illustration showing the HV cable set in an overall view.

FIG. 5 shows a complete view of the HV cable set 2. Here, it is possible to clearly see the three cables 4 surrounded by the shield 6. At the end side, the cables run into an HV component 30. Extending from the latter is the connection piece 10 on which the shield 6 and the contact sleeve 16 are mounted.

The following is a summary list of reference numerals and the corresponding structure used in the above description of the invention:

2 HV cable set
4 Cable
6 Shield
8 Tension relief means
10 Connection piece
12 Sealing material
14 Encircling groove
16 Contact sleeve
17 Longitudinal slot
18 Interior space
20 Contact surface
22 Free region
24 Touching region
26 Recess
30 HV component
R Radial direction
L Longitudinal direction
L1 Length

The invention claimed is:

1. A high voltage (HV) cable set, comprising:
a common shield;
a number of cables surrounded by said common shield;
a contact sleeve being made from a conductive material; and
a connection piece composed of a conductive material, said connection piece being formed as a cast part and said contact sleeve being partially encapsulated by casting in said connection piece, said connection piece being electrically connected to said common shield by virtue of said contact sleeve being integrated into said connection piece, said contact sleeve fastened to said common shield, said connection piece being spatially separated from and not in direct contact with said common shield;
said contact sleeve has an encircling free region which is encapsulated by casting in a sealing material being foamed or injection molded.

2. The HV cable set according to claim 1, wherein said contact sleeve is manufactured from material whose electrochemical standard potential differs by no more than 0.05 V, from that of a material of said common shield.

3. The HV cable set according to claim 1, wherein said connection piece is manufactured from aluminum.

4. The HV cable set according to claim 1, wherein said common shield is manufactured as a braid composed of a multiplicity of tin-plated copper wires.

5. The HV cable set according to claim 1, wherein said contact sleeve is manufactured from brass.

6. The HV cable set according to claim 1, wherein said common shield is cohesively connected to said contact sleeve.

7. The HV cable set according to claim 1, wherein said contact sleeve is seated in a longitudinal direction in said connection piece.

8. The HV cable set according to claim 1, wherein said contact sleeve has a number of recesses formed therein and through said recesses, said sealing material extends.

9. The HV cable set according to claim 1, wherein said sealing material forms a housing shell which, on an outside, has an encircling groove formed therein for receiving a cable tie.

10. The HV cable set according to claim 1, wherein said contact sleeve has an interior space in which a tension relief device is disposed.

11. The HV cable set according to claim 1, further comprising a connection part, the HV cable set is connected by means of said connection part to an electrical HV component of a vehicle.

12. The HV cable set according to claim 6, wherein said common shield is connected to said contact sleeve by soldering or welding.

13. The HV cable set according to claim 1, wherein said connection piece is manufactured from aluminum, said common shield is manufactured as a braid composed of a multiplicity of tin-plated copper wires, and said contact sleeve is manufactured from brass.

* * * * *